US005092579A

United States Patent [19]

Tokoro et al.

[11] Patent Number: 5,092,579

[45] Date of Patent: Mar. 3, 1992

[54] MECHANISM FOR PREVENTING SKEW OF CUT PAPER SHEET

[75] Inventors: Hiroyoshi Tokoro; Mitsuaki Hayakawa; Kazuo Sugano, all of Ibaraki, Japan

[73] Assignee: Hitachi Koki Co., Ltd., Tokyo, Japan

[21] Appl. No.: 448,362

[22] Filed: Dec. 11, 1989

[30] Foreign Application Priority Data

Dec. 16, 1988 [JP] Japan ..... 63-319153

[51] Int. Cl.[5] ..... B65H 9/00

[52] U.S. Cl. ..... 271/240; 271/184; 271/186; 271/248; 271/291

[58] Field of Search ..... 271/225, 226, 229, 234, 271/239, 240, 248, 250, 184, 185, 291, 236, 238, 186; 355/317-320

[56] References Cited

U.S. PATENT DOCUMENTS 4,657,239 4/1987 Ikesue et al. ..... 271/248
4,736,937 4/1988 Okuda et al. ..... 271/9

FOREIGN PATENT DOCUMENTS 0126063 6/1987 Japan ..... 271/226
0092557 4/1988 Japan ..... 271/226

*Primary Examiner*—David H. Bollinger
*Assistant Examiner*—Steven Kennemore
*Attorney, Agent, or Firm*—Michael L. Keller

[57] ABSTRACT

A mechanism for preventing the skew of a cut paper sheet, for use in a duplex printing machine or a paper reversing mechanism having a switchback mechanism for switching the cut sheet backward from its trailing end by reverse rollers and so on immediately after the cut sheet subjected to the printing at a printing portion is once discharged onto a reverse plate by paper discharge rollers and so on, the mechanism comprising: a plurality of paper guides formed on a surface of the reverse plate of the switchback mechanism so as to limit the lateral movement of the cut sheets of several kinds in the direction of the width thereof, the paper guides being arranged in a manner to correspond respectively to the widths of the cut sheets of several kinds to be discharged onto the reverse plate, the distance between each two paper guides for guiding a respective one of the cut sheets being slightly greater than the width of the corresponding cut sheet, and the paper guide for guiding the wider cut sheet being higher than the paper guide for guiding the narrower cut sheet, whereby each of the cut sheets discharged onto the reverse plate is guided by the corresponding paper guides according to the size of the cut sheet, and is switched backward, thereby preventing the skew of the cut sheet.

5 Claims, 2 Drawing Sheets

MECHANISM FOR PREVENTING SKEW OF CUT PAPER SHEET

BACKGROUND OF THE INVENTION

This invention relates generally to a mechanism for preventing the skew of a cut paper sheet, and more particularly to such a skew prevention mechanism used in a duplex printing machine and a paper reversing device.

FIG. 6 is a schematic side-elevational view of a duplex printing laser printer, and a conventional duplex printing laser printer will now be described with reference to FIG. 6. A photosensitive drum 1 is electrified by an electrifier 2, and a latent image is formed on the photosensitive drum 1 by a laser light 3. A toner 12 is deposited on the latent image by a developing device 4, so that the latent image is converted into a visible image. A paper sheet 6 fed by a paper supply roller 5 is fed to a transfer portion of the photosensitive drum 1 by feed rolls 7, and the toner image on the photosensitive drum 1 is transferred to the paper sheet by a transfer corotron 8. After the transfer, the static charge is eliminated from the sheet 6 by a separating corotron 9, and the sheet 6 is separated from the photosensitive drum 1. Thereafter, the sheet 6 is conveyed by a conveyer belt 10 to a fixing device 11 where the transferred image on the sheet 6 is fixed. The residual toner, which has not been transferred to the sheet 6 and hence remains on the photosensitive drum 1, is removed from the photosensitive drum 1 by a cleaner 13 and is recovered.

The sheet 6 subjected to the printing at one side thereof is discharged onto a reverse plate 15 by paper discharge rollers 14. Then, the sheet 6 is again fed into the machine from the its trailing end by reverse rollers 16 (a conventional switchback mechanism) which are rotating in contact with one row of the paper discharge rollers 14. Immediately after the reverse roller 16, there is provided a paper path-switching gate 17, and one paper path is led to a return paper path 18 leading to a printing portion whereas the other paper path is led to a stacker 19.

FIG. 7 is a perspective view of the conventional switchback mechanism. One paper path is led to the printing portion by the switching gate 17 whereas the other paper path is led to the stacker 19. More specifically, through the operation of the switching gate 17, a paper sheet 20 subjected to the printing at one side thereof is fed to the return paper path 18 from its trailing end, and is again fed to the photosensitive drum 1 by the feed rolls 7, so that the printing process is repeated to thereby complete the duplex printing. The sheet 21 whose both sides have been subjected to the printing is conveyed by the conveyer belt 10 to the fixing device 11, and then is discharged by the paper discharge rollers 14.

At this time, the sheet 21 is again discharged onto the reverse plate 15, and then is again pulled by the reverse rollers 16 from its trailing end, and the switching gate 17 is operated to discharge the sheet 21 to the stacker 19. The above operation is repeated, thereby successively effecting the duplex printings of paper sheets.

However, the above-mentioned prior art has the following disadvantages:

(1) Immediately after the sheet 20 subjected to the printing at its one side is completely discharged onto the reverse plate 15 by the paper discharge rollers 14, the sheet 20, which is now free to move, tends to become slightly oblique (this phenomenon is commonly referred to as "skew") before the trailing end of the sheet 20, becomes engaged with the reverse rollers 16. As a result, the sheet is liable to become jammed in the return paper path 18.

(2) This problem, that is, the paper skew on the reverse plate 15, is liable to occur when the sheet 21 subjected to the printing at the both sides thereof is to be discharged to the stacker 19, which tends to cause the jamming in the stacker.

(3) In order to prevent the skew on the reverse plate 15, it is considered to provide fixed guides corresponding to the maximum width of the paper sheet to be used. However, when paper sheet of other sizes are to be used, the fixed guides can not be adjustably moved, and therefore the skew would also occur.

(4) In connection with the above paragraph (3), it is also considered to provide a movable guide, for example, of the sliding type. However, the operation is cumbersome, and when the operation of such a movable guide is forgotten, the jamming may occur.

SUMMARY OF THE INVENTION

With the above defects of the prior art in view, it is an object of this invention to provide a mechanism for preventing the skew of a cut paper sheet, which reduces the possibility of the jamming and skew of the paper sheet in a duplex printing machine or a paper reversing device, having a paper switchback mechanism, thereby enhancing the reliability and operability of such machine or device.

According to the present invention, there is provided a mechanism for preventing the skew of a cut paper sheet, for use in a duplex printing machine or a paper reversing mechanism having a switchback mechanism for switching the cut sheet backward from its trailing end by reverse rollers and so on immediately after the cut sheet subjected to the printing at a printing portion is once discharged onto a reverse plate by paper discharge rollers and so on, said mechanism comprising:

a plurality of paper guides formed on a surface of the reverse plate of the switchback mechanism so as to limit the lateral movement of the cut sheets of several kinds in the direction of the width thereof, said paper guides being arranged in a manner to correspond respectively to the widths of the cut sheets of several kinds to be discharged onto the reverse plate, the distance between each two paper guides for guiding a respective one of the cut sheets being slightly greater than the width of the corresponding cut sheet, and said paper guide for guiding the wider cut sheet being higher than said paper guide for guiding the narrower cut sheet, whereby each of the cut sheets discharged onto the reverse plate is guided by the corresponding paper guides according to the size of the cut sheet, and is switched backward, thereby preventing the skew of the cut sheet.

With this construction, the skew of the cut sheet is prevented, and therefore the possibility of the jamming of the cut sheet is reduced, thereby enhancing the reliability of the machine. Further, even if the cut sheets of different sizes are used, the paper guides corresponding to the selected cut sheet serve to guide the cut sheet, and therefore the adjustment of the width of the guide means is not needed, thus enhancing the operability.

DESCRIPTION OF THE PREFERRED EMBODIMENT OF THE INVENTION

One preferred embodiment of the present invention will now be described with reference to FIGS. 1 to 5.

Figure 1:
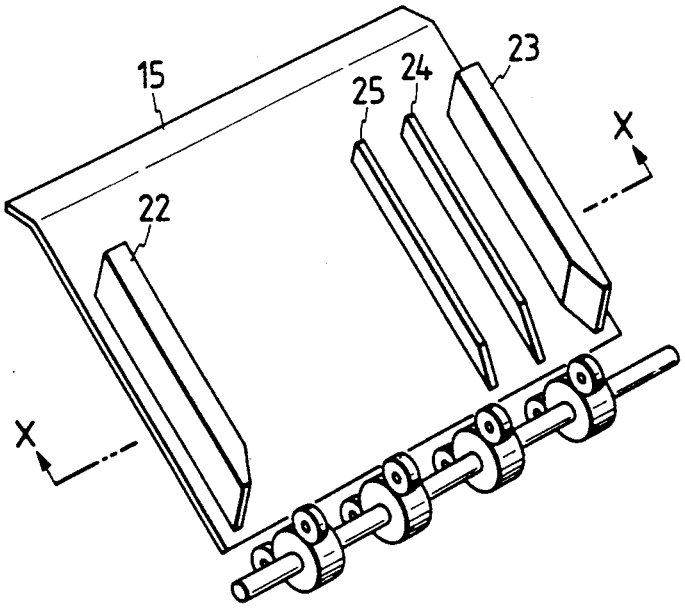
FIG. 1 is a perspective view of a mechanism for preventing the skew of a cut paper sheet, provided in accordance with the present invention.

FIG. 1 shows a mechanism for preventing the skew of a cut paper sheet, provided in accordance with the present invention. This skew prevention mechanism comprises first to fourth elongated paper guides 22, 23, 24 and 25 formed on an upper surface of a reverse plate 15 in parallel relation to one another, these guides being spaced from one another in the direction of the width of the reverse plate 15. The paper guides 22, 23, 24 and 25 serve to limit the lateral movement of paper sheets of three sizes in the direction of the width thereof, as later described.

Figure 2:
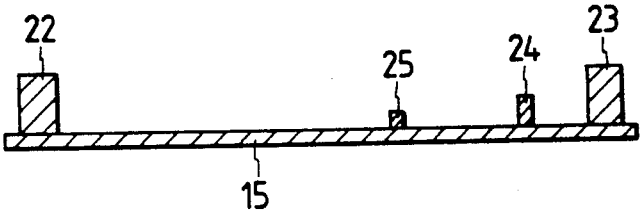
FIG. 2 is a cross-sectional view taken along the line X—X of FIG. 1.

The distance or width between the first and second paper guides 22 and 23 generally corresponds to the width of an A4- size paper sheet 26. The distance between the first and third paper guides 22 and 24 generally corresponds to the width of a letter-size paper sheet 27. The distance between the first and fourth paper guides 22 and 25 generally corresponds to the width of a B5-size paper sheet 28. More specifically, each of these distances is slighter greater than the width of the corresponding paper sheet. As shown in FIG. 2, the first and second paper guides 22 and 23 are substantially equal in height to each other, and with respect to the paper guides 23 to 25, one of each adjacent two paper guides remote from the paper guide 22 is higher than the other close to the paper guide 22. In other words, the paper guide 24 is higher than the paper guide 25, and the paper guide 23 is higher than the paper guide 24.

Figure 3:
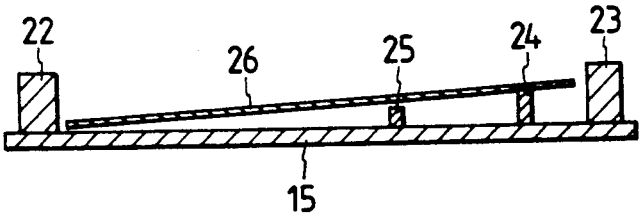
FIGS. 3 to 5 are views similar to FIG. 2, showing the modes of the operation in which an A4-size paper sheet, a letter-size paper sheet and a B5-size paper sheet are employed, respectively.
Figure 4:
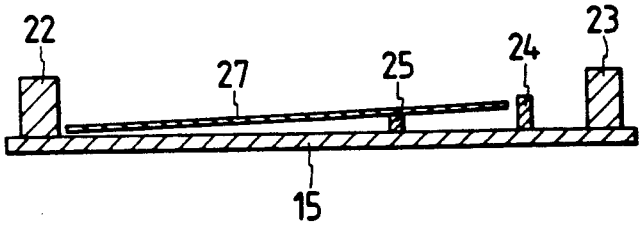
Figure 5:
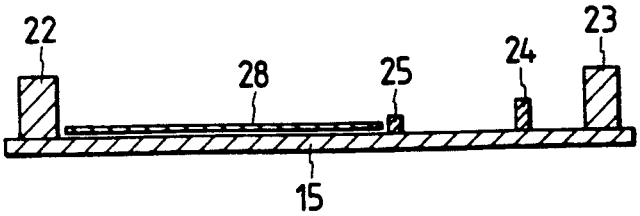
Figure 6:
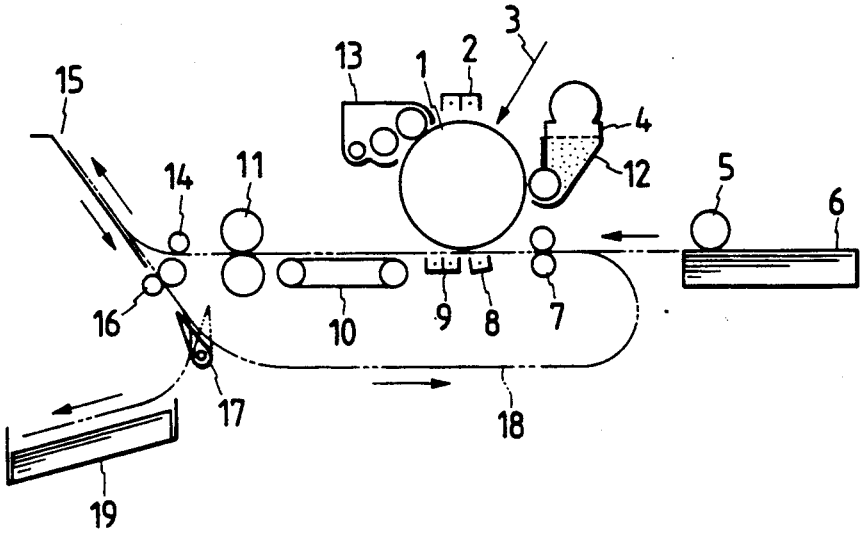
FIG. 6 PRIOR ART
FIG. 6 is a schematic side-elevational view of a duplex printing laser printer.
Figure 7:
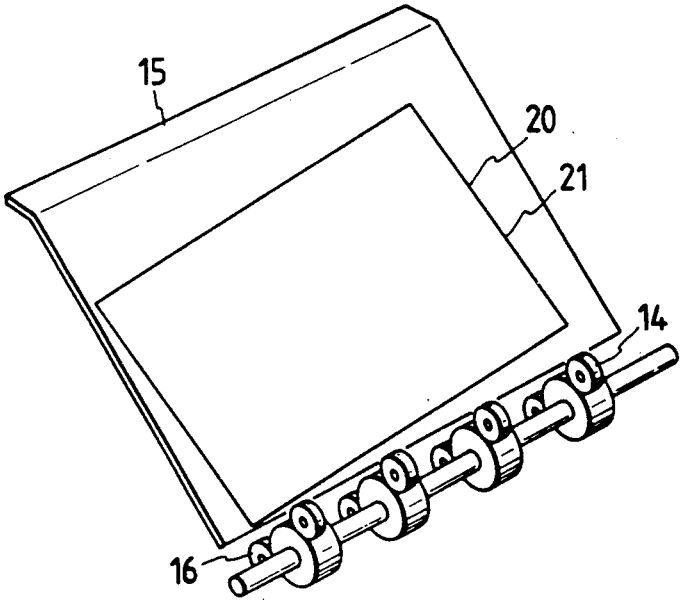
FIG. 7 PRIOR ART
FIG. 7 is a perspective view of a conventional switchback mechanism.

FIG. 3 shows the condition in which the A4-size paper sheet 26 is discharged onto the reverse plate 15, and similarly FIG. 4 shows the letter-size paper sheet 27 as discharged onto the reverse plate 15, and FIG. 5 shows the B5-size paper sheet 28 as discharged onto the reverse plate 15. In FIG. 3, the A4-size paper sheet 26 rests on the third and fourth paper guides 24 and 25, and the lateral edges of this sheet are guided by the first and second paper guides 22 and 23, respectively. In FIG. 4, the letter-size paper sheet 27 rests on the fourth paper guide 25, and the lateral edges of this paper sheet are guided by the first and third paper guides 22 and 24, respectively. In FIG. 5, the B5-size paper sheet 28 lies flat against the upper surface of the reverse plate 15, and the lateral edges of this paper sheet are guided by the first and fourth paper guides 22 and 25, respectively.

Thus, even when the paper sheets of different sizes are discharged onto the reverse plate 15, they can be properly guided by their corresponding paper guides, thereby preventing the skew of the paper sheet on the reverse plate 15.

As described above, in the present invention, the paper sheet is prevented from being subjected to skew on the reverse plate, which reduces the possibility of the jamming and skew of the paper sheet in a duplex printing machine or a paper reversing device, having a paper switchback mechanism, thereby enhancing the reliability of such machine. Further, even when the paper sheets of different sizes are used, the paper guides corresponding to a respective one of the paper sheets function to properly guide the movement of the same, and therefore there is no need to adjust the width of the guide means, thus enhancing the operability.

While there has been described in connection with the preferred embodiment of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A mechanism for preventing the skew of a cut paper sheet, for use in a duplex printing machine or a paper reversing mechanism having a switchback mechanism for switching the cut sheet backward from its trailing end by reverse device immediately after the cut sheet subjected to the printing at a printing portion is once discharged onto a reverse plate by paper discharge device, said mechanism comprising:

means for guiding each of the cut sheets discharged onto the reverse plate, said guiding means having a plurality of paper guides, said paper guides being formed on a surface of the reverse plate of the switchback mechanism so as to limit the lateral movement of the cut sheets of different sizes in the direction of the width thereof, said paper guides being arranged in a manner to correspond respectively to the widths of the cut sheets of different sizes to be discharged onto the reverse plate, wherein said guiding means comprises first to fourth elongated paper guides formed on an upper surface of the reverse plate in parallel relation to ne another, sad guides being spaced apart from one another in the direction of the width of the reverse plate and wherein said first elongated paper guide is substantially adjacent to one widthwise edge of said reverse plate so as to engage a side edge of the cut sheets and said second elongated paper guide is substantially adjacent to the second widthwise edge of said reverse plate so as to guide an opposite side edge of the cut sheets and said third and fourth elongated paper guides spaced intermediate said first and second guides so as to guide an opposite side edge of the cut sheets and wherein further said fourth, third and second guides are in stepped manner heightwise so as to accommodate the different sheet sizes.

2. A mechanism according to claim 1, in which the distance between the first and second paper guides generally corresponds to the width of an A4-size paper sheet, the distance between the first and third paper guides generally corresponds to the width of a letter-size paper sheet, and the distance between the first and fourth paper guides generally corresponds to the width of a B5-size paper sheet.

3. A mechanism according to claim 2, in which each of said distances is slighter greater than the width of the corresponding paper sheets.

4. A mechanism according to claim 1, in which said first and second paper guides are substantially equal in height to each other.

5. A mechanism according to claim 4, in which said second guide is higher than the third guide, and the third guide is higher than the fourth guide.

* * * * *